US010375987B2

(12) United States Patent
Boleslawski et al.

(10) Patent No.: US 10,375,987 B2
(45) Date of Patent: Aug. 13, 2019

(54) CENTERING DEVICE FOR ROD-SHAPED ARTICLES OF THE TOBACCO INDUSTRY

(71) Applicant: International Tobacco Machinery Poland Sp. z o. o., Radom (PL)

(72) Inventors: Andrzej Boleslawski, Radom (PL); Bartosz Cieslikowski, Radom (PL)

(73) Assignee: International Tobacco Machinery Poland Sp. z o.o., Random (PL)

( * ) Notice: Subject to any disclaimer, the term of this patent is extended or adjusted under 35 U.S.C. 154(b) by 0 days.

(21) Appl. No.: 15/768,835

(22) PCT Filed: Nov. 17, 2016

(86) PCT No.: PCT/IB2016/056923
§ 371 (c)(1),
(2) Date: Apr. 17, 2018

(87) PCT Pub. No.: WO2017/085658
PCT Pub. Date: May 26, 2017

(65) Prior Publication Data

US 2018/0303153 A1 Oct. 25, 2018

(30) Foreign Application Priority Data

Nov. 19, 2015 (PL) ..... 414854

(51) Int. Cl.
*A24C 5/32* (2006.01)
*A24C 5/47* (2006.01)

(52) U.S. Cl.
CPC ..... *A24C 5/327* (2013.01); *A24C 5/471* (2013.01); *A24C 5/478* (2013.01)

(58) Field of Classification Search
CPC ..... A24C 5/327; A24C 5/478; A24C 5/471
See application file for complete search history.

(56) References Cited

U.S. PATENT DOCUMENTS 2,821,201 A 1/1958 Brunswig et al.
4,841,993 A * 6/1989 Hinz et al. ..... A24C 5/471 131/94

(Continued)

FOREIGN PATENT DOCUMENTS

EP 1913822 4/2008
GB 902448 8/1962

(Continued)

OTHER PUBLICATIONS

Third-Party Observation in PCT/IB2016/056923, Feb. 14, 2018.

(Continued)

*Primary Examiner* — Michael H. Wilson
*Assistant Examiner* — Dionne W. Mayes
(74) *Attorney, Agent, or Firm* — Oppedahl Patent Law Firm LLC

(57) ABSTRACT

An apparatus (10, 20, 30, 40) for shifting of rod-shaped articles (4, 4') of different lengths or rod-shaped article groups (6) of different total lengths on a drum conveyor (2), comprising a pushing unit (5, 25, 35) mounted angularly to the axis of rotation of the drum conveyor (2), forcing the movement of the rod-shaped articles (4, 4'), whereas the pushing unit (5, 25, 35) comprises rotational pushing elements (11, 21, 31) for shifting of the rod-shaped articles (4, 4'), characterised in that the pushing unit (5, 25, 35) is movably mounted in a direction being substantially transverse to the axis of the flute (3) of the drum conveyor (2) so as to shift the rod-shaped-articles (4, 4') or the rod-shaped article groups (6) inside the flute (3) of the drum conveyor (2) by the pressure of surfaces (11A, 21A, 31A) of the pushing unit (5, 25, 35) directly on the ends of the rod-shaped article (4, 4').

8 Claims, 8 Drawing Sheets

(56) References Cited

U.S. PATENT DOCUMENTS

Figure 1:
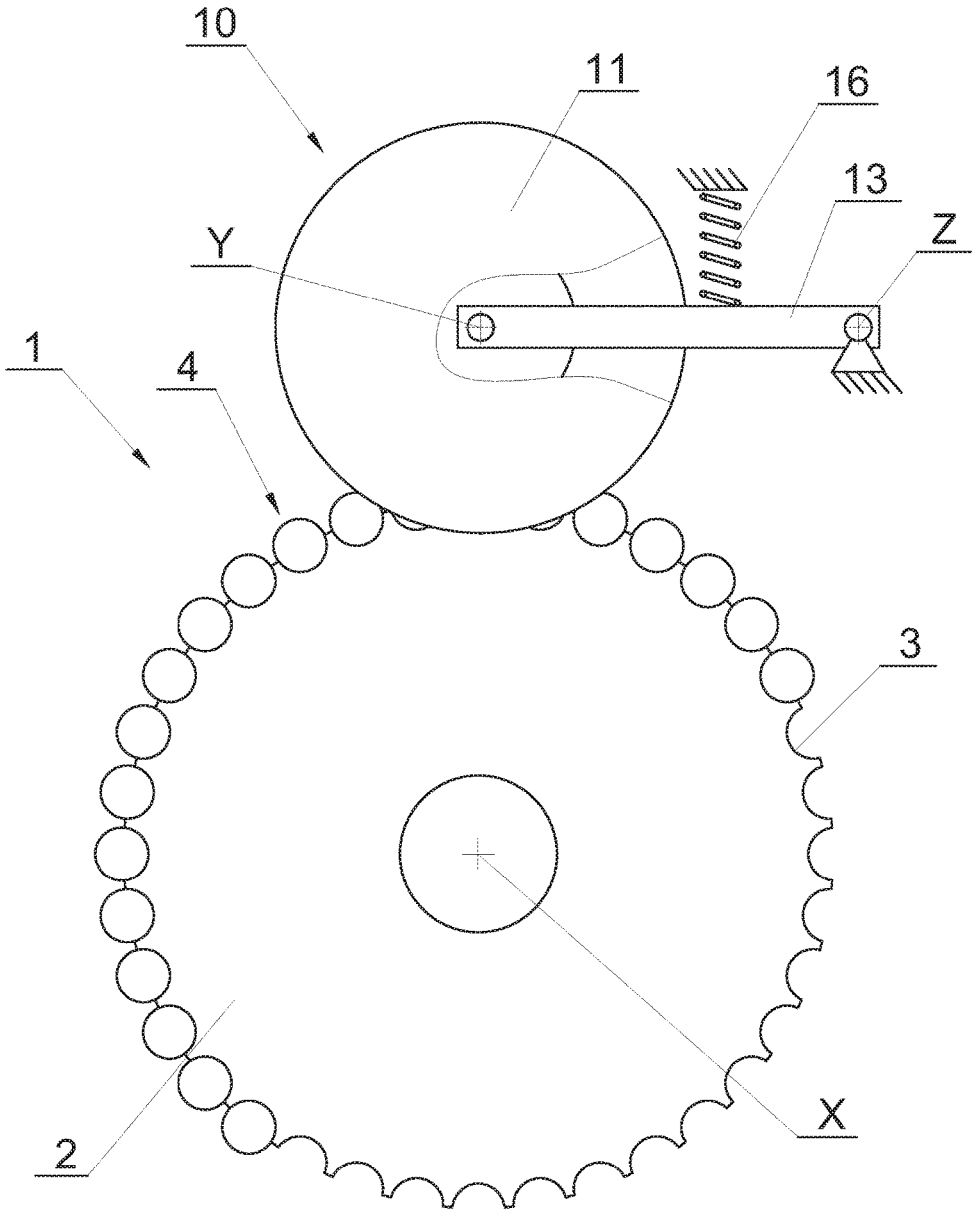

| | | | | |
|---|---|---|---|---|
| 4,962,771 | A | 10/1990 | Neri | |
| 5,135,008 | A * | 8/1992 | Oesterling et al. .... | A24C 5/471 131/84.4 |
| 7,255,219 | B2 * | 8/2007 | Rinke et al. ..... | A24C 5/478 131/282 |
| 2006/0144409 | A1 * | 7/2006 | Dombek ..... | A24C 5/478 131/94 |

FOREIGN PATENT DOCUMENTS

| | | | |
|---|---|---|---|
| GB | 2007963 | A | 5/1979 |
| GB | 2010660 | A | 7/1979 |

OTHER PUBLICATIONS

Applicant Comments on Third-Party Observation in PCT/IB2016/056923, Mar. 16, 2018.
Written Opinion in PCT/IB2016/056923, dated Feb. 8, 2017.
International Search Report in PCT/IB2016/056923, dated Feb. 8, 2017.

* cited by examiner

CENTERING DEVICE FOR ROD-SHAPED ARTICLES OF THE TOBACCO INDUSTRY

The object of the invention is a method for shifting of rod-shaped articles, and an apparatus for shifting of rod-shaped articles.

A method and an apparatus according to the invention can be used in tobacco industry machines on drum conveyors provided with flutes to convey individual rod-shaped articles or rod-shaped article groups. The rod-shaped articles may be held in the flutes by means of an external guiding jacket or by means of negative pressure supplied to holes made in the flute bottoms. Furthermore, it is possible to shift the articles along the flutes in order to set their position before the next operation to which they will be subjected. For example, it may be the cutting of the articles within the same conveyor or the transfer of a whole prepared article group to a next conveying unit where they will be wrapped into a wrapping material.

In the prior art, the document U.S. Pat. No. 3,094,128 (US '128) disclosing an apparatus for shifting of rod-like articles in flutes of a drum conveyor is known. The apparatus according to US '128 comprises slidably mounted pusher elements which shift the rod-shaped articles inside the flute of the drum conveyor. The pusher elements of the known solution are pushed to abut at a fixed angle by a rotatably mounted pushing element. The apparatus discloses a method for aligning the position of rod-shaped articles and may be used in the case of rod-shaped articles of a constant length. A problem which remains unsolved in the prior art is how to push to abut the rod-shaped articles of different lengths, in particular there is a problem of centering of rod-shaped articles of different lengths, i.e. such positioning of articles in the flutes of the drum conveyor that the centres of rod-shaped articles or rod-shaped article groups would be situated substantially in a common plane.

The object of the invention is a method for shifting of rod-shaped articles wherein: at least one rod-shaped article or a rod-shaped article group is conveyed in a flute situated on the circumference of a drum conveyor, whereas the lengths of the rod-shaped articles or the total lengths of the rod-shaped article groups in each of the flutes may vary, whereas a pushing unit forcing the movement of the rod-shaped articles is shifted in a direction being substantially transverse to the axis of the flute of the drum conveyor, whereas the pushing unit has surfaces situated angularly relative to the axis of the flute of the drum conveyor. The method according to the invention is characterised in that the rod-shaped articles or the rod-shaped article groups are axially shifted in the flutes by means of the surfaces of the pushing unit.

The method according to the invention is characterised in that that the rod-shaped articles or the rod-shaped article groups are axially shifted in the flutes directly by means of the surfaces of the pushing unit.

The method according to the invention is characterised in that at least two pushing units mounted on both sides of the flute of the drum conveyor are shifted in a direction being substantially transverse to the axis of the rod-shaped article or the rod-shaped article group, whereas by means of the surfaces of the pushing unit situated on both sides of the flute of the drum conveyor the force exerted by the pushing unit is directed on the rod-shaped articles so that the centres of rod-shaped articles or rod-shaped article groups in the flutes of the drum conveyor are positioned substantially in a common plane.

The object of the invention is also an apparatus for shifting of rod-shaped articles with different lengths or rod-shaped article groups with different total lengths on a drum conveyor, comprising a pushing unit mounted angularly to the axis of rotation of the drum conveyor forcing a movement of the rod-shaped articles, whereas the pushing unit comprises rotational pushing elements for shifting of the rod-shaped articles. The apparatus according to the invention is characterised in that the pushing unit is movably mounted in a direction being substantially transverse to the axis of the flute of the drum conveyor so as to shift the rod-shaped articles or the rod-shaped article groups inside the flute of the drum conveyor by the pressure of the surfaces of the pushing unit on the ends of the rod-shaped article.

The apparatus according to the invention is characterised in that the pushing unit is movably mounted in a direction being substantially transverse to the axis of the flute of the drum conveyor so as to shift the rod-shaped articles or the rod-shaped article groups inside the flute of the drum conveyor by the pressure of the surfaces of the pushing unit directly on the ends of the rod-shaped article.

The apparatus according to the invention is characterised by comprising at least two pushing units mounted angularly to the axis of the flute, on both sides of the flute of the drum conveyor, whereas the pushing units are movably mounted in a direction being substantially transverse to the axis of the flute of the drum conveyor so as to shift the rod-shaped articles or the rod-shaped article groups inside the flute of the drum conveyor so that the centres of the rod-shaped articles or the rod-shaped article groups in the flutes of the drum conveyor position themselves substantially in a common plane.

The apparatus according to the invention is characterised in that the contact of the rotational pushing elements of the pushing unit with the rod-shaped articles or the rod-shaped articles groups is accomplished by means of a spring.

The apparatus according to the invention is characterised in that the rotational pushing elements have surfaces selected from the group: conical, spherical, cylindrical, paraboloidal surface.

Due to the use of at least two pushing units symmetrically acting symmetrically from both sides on the rod-shaped article group, a favourable effect of centering of rod-shaped articles is achieved as a result of the fact that the forces from the circumferential surfaces of the pushing elements act on the front surfaces of the articles on the same sections of the flute. Since the pushing units are rigidly connected with each other, the system finds a point of equilibrium of forces and fixes its position when the rod-shaped article or the rod-shaped article group is centered between the pushing elements.

The disclosed apparatus according to the invention has a very simple structure, and at the same time it is reliable in operation. The apparatus allows the positioning of rod-shaped articles of different lengths, thus avoiding the necessity of precise sorting thereof with regard to the length.

Figure 2A:
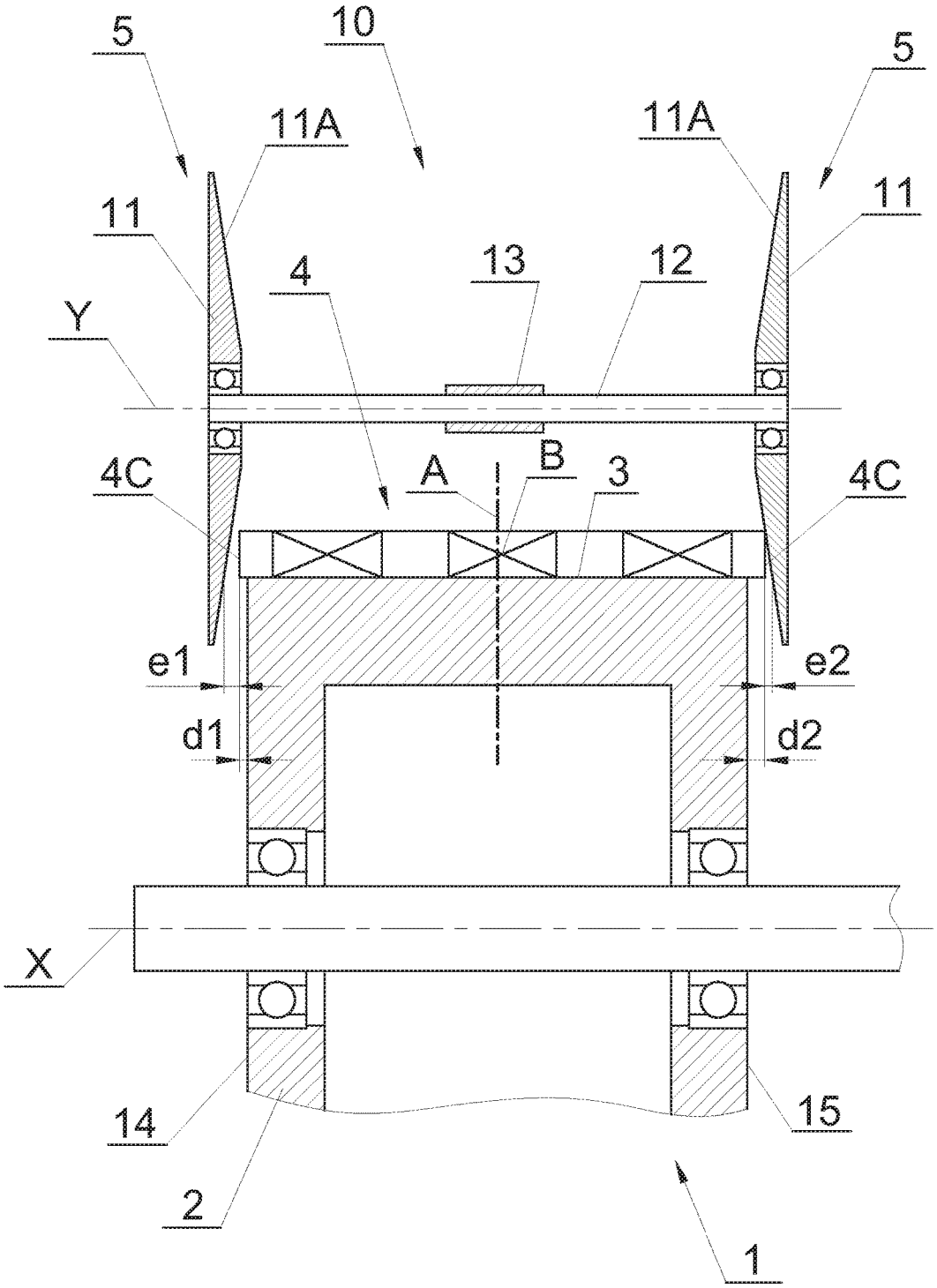
Figure 2B:
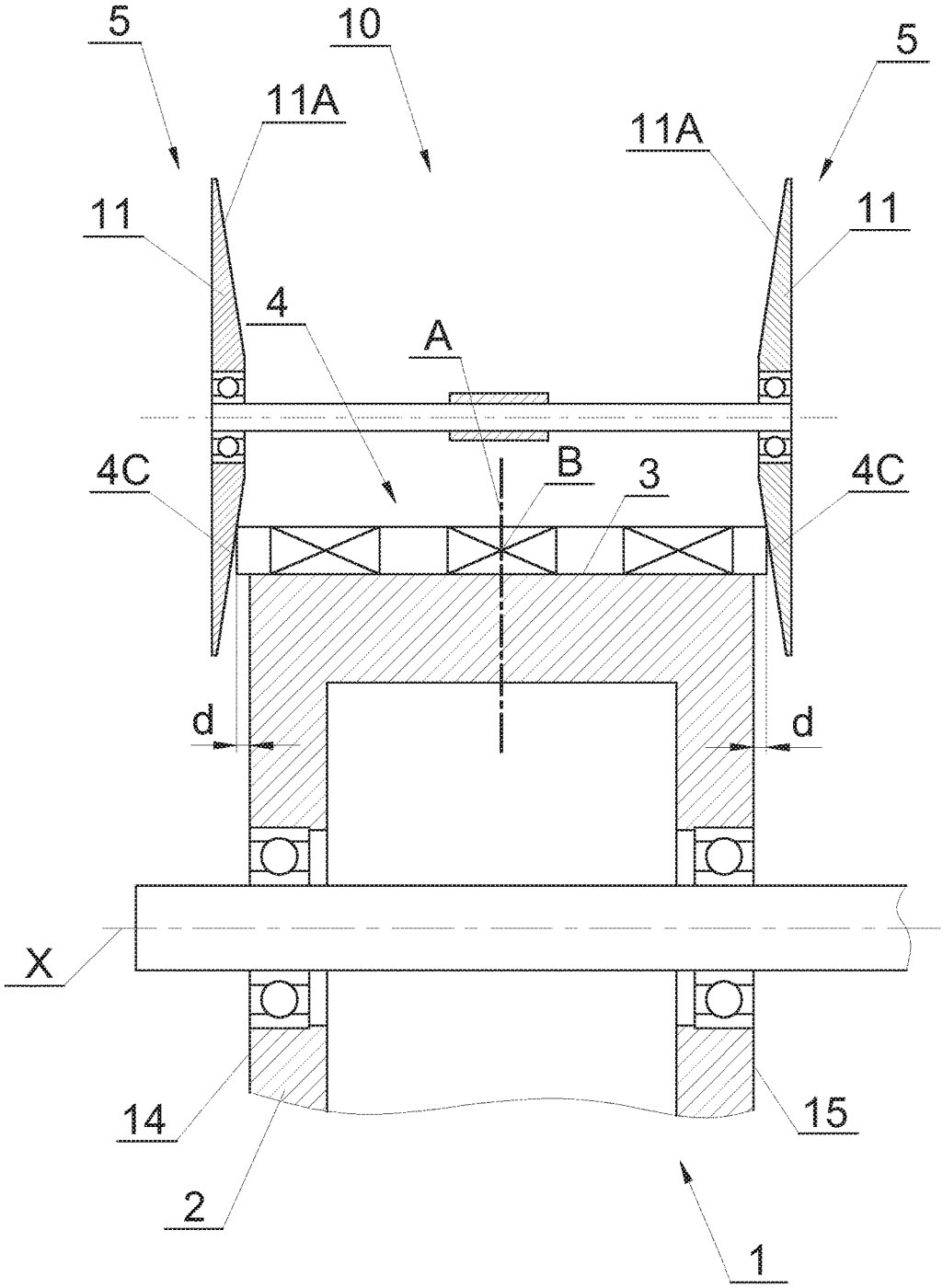
Figure 2C:
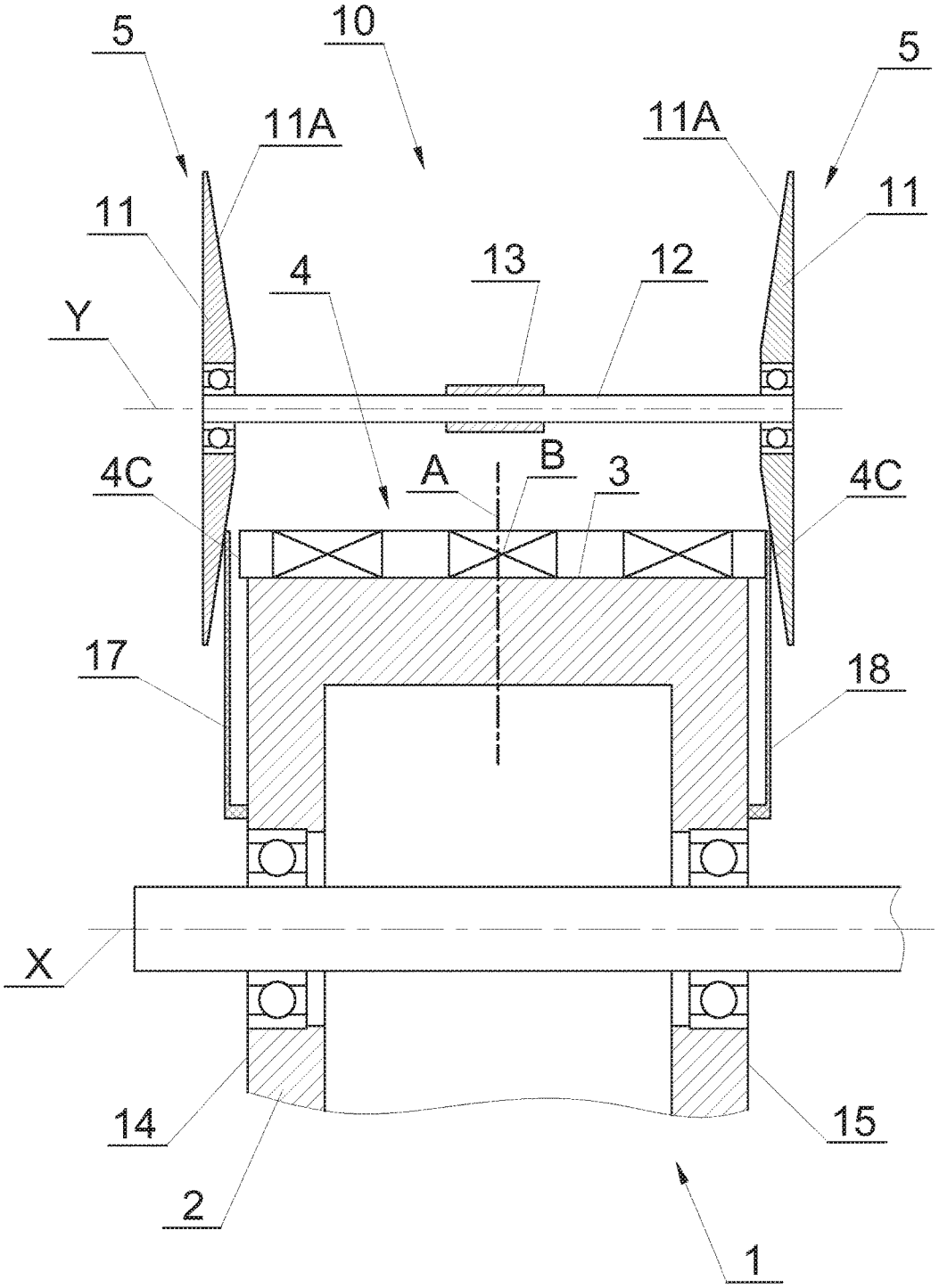
Figure 3A:
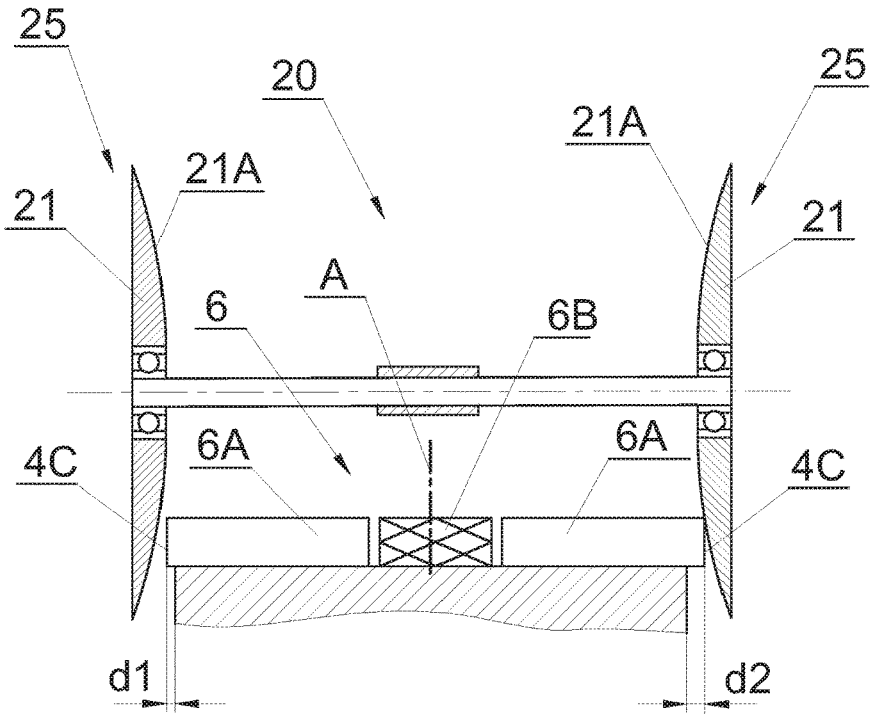
Figure 3B:
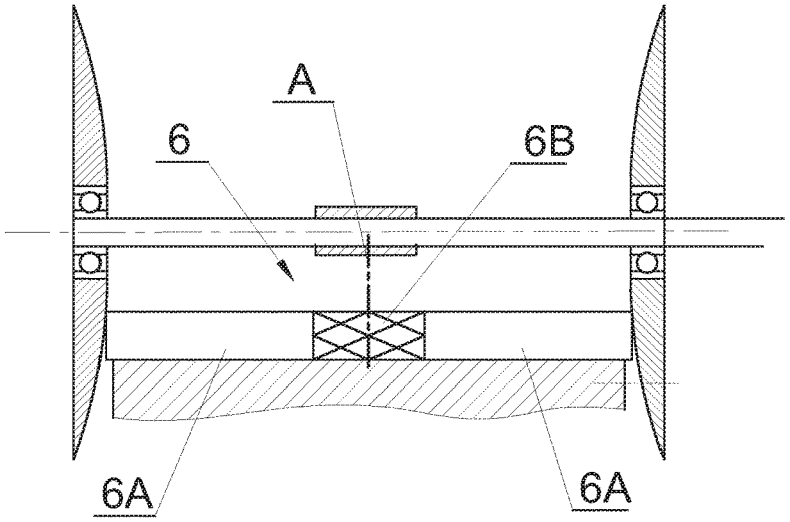
Figure 4A:
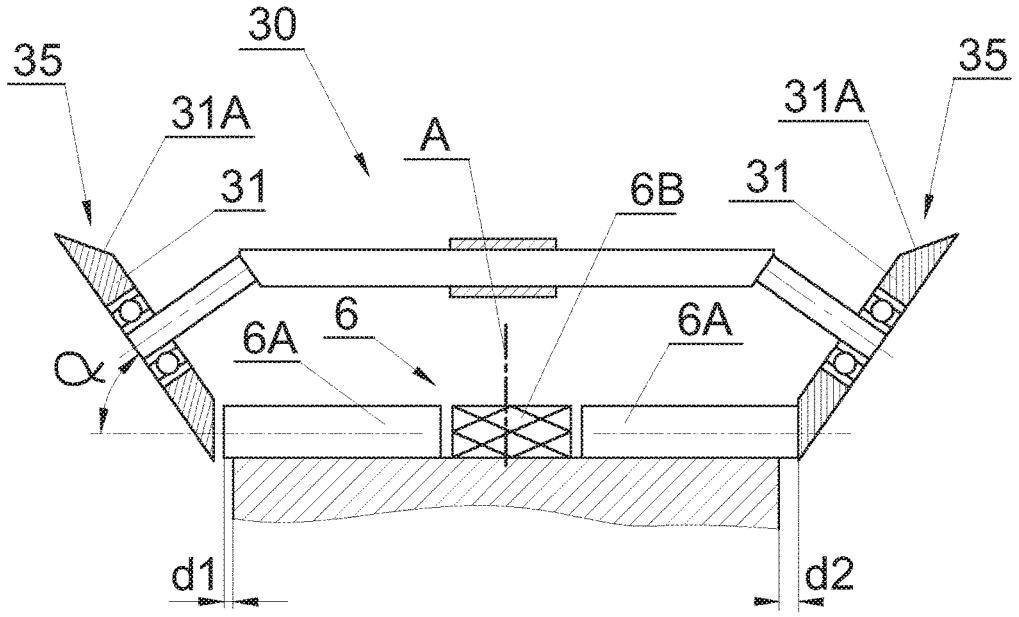
Figure 4B:
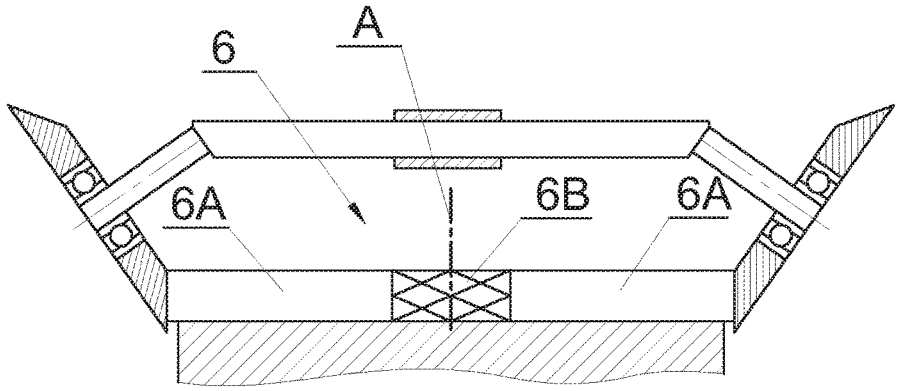
Figure 5:
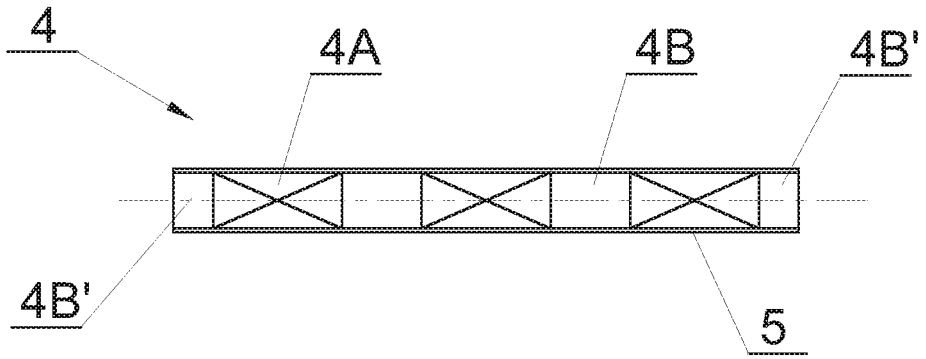
Figure 6:
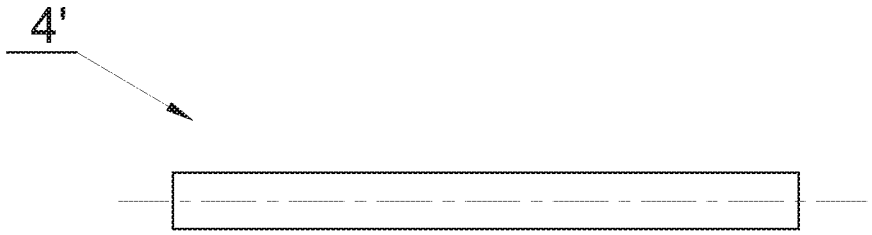
Figure 7:
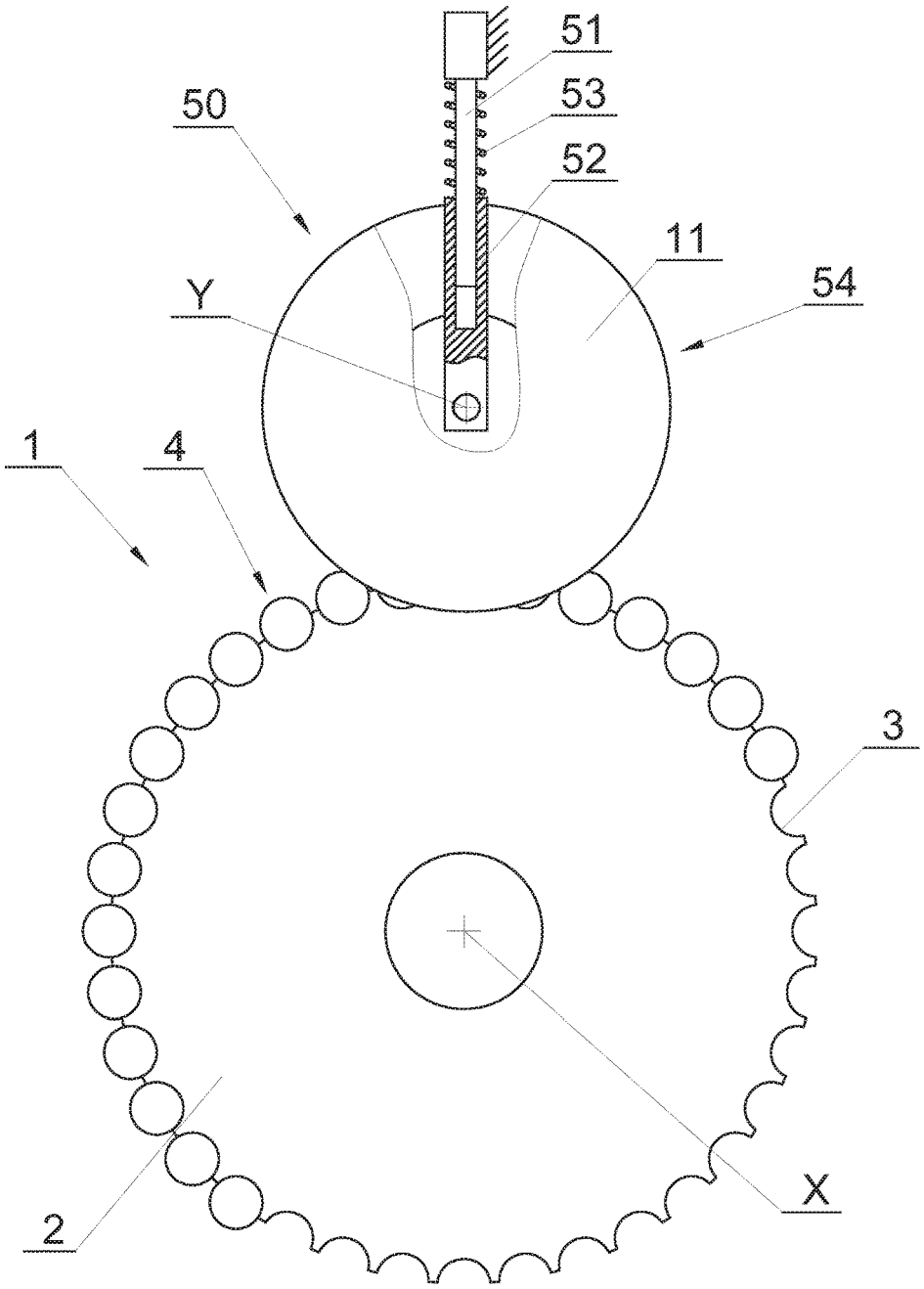

The object of the invention was shown in detail in a preferred embodiment in a drawing in which:

FIG. 1—shows a drum conveyor in an axial view;

FIG. 2*a*, 2*b*—show an axial section through the conveyor of FIG. 1 in the initial and final stages of shifting of rod-shaped articles in a flute of the conveyor in a first embodiment;

FIG. 2*c*—show an axial section through the conveyor of FIG. 1 in the initial stage of shifting of rod-shaped articles in a flute of the conveyor in the first embodiment with the use of an intermediate element;

FIG. 3*a*, 3*b*—show an axial section through the conveyor of FIG. 1 in the initial and final stages of shifting of rod-shaped articles in a flute of the conveyor in a second embodiment;

FIG. 4*a*, 4*b*—show an axial section through the conveyor of FIG. 1 in the initial and final stages of shifting of rod-shaped articles in a flute of the conveyor in a third embodiment;

FIG. 5—shows a rod consisting of a plurality of rod-shaped articles;

FIG. 6—shows an individual rod-shaped article;

FIG. 7—shows a second variant of the drum conveyor in an axial view.

A drum conveyor 1 shown in FIGS. 1, 2*a* and 2*b* comprises a drum 2 adapted to rotate around the axis of rotation X. The drum 2 has, on its circumference, a plurality of flutes 3 for conveying of rod-shaped articles 4 transversely to the axis of the articles 4, the flutes 3 being situated parallel to the axis of rotation X of the drum 2. The rod-shaped articles 4 are placed into the flutes 3 of the drum 2, whereas the articles 4 are usually placed into the flutes 3 by a preceding conveyor. FIG. 2*a* shows a rod-shaped article 4 in the form of a multi-element rod, in other words, it is a rod-shaped article group joined with a common wrapping material. The multi-element rod 4 shown in FIG. 5 is built of rod-shaped articles 4A, 4B, and 4B' alternately situated along the axis (a half of the article 4B) and is wrapped with a common wrapping material 5. The rod-shaped articles are usually held in the flutes by means of negative pressure supplied through holes situated along the flutes 3 (the negative pressure holes are not shown). In the embodiment shown, the ends 4C of the articles 4B' protrude beyond the front surfaces 14 and 15 of the drum 2 (FIG. 2*a*). The shown apparatus 10 for shifting of the rod-shaped articles is provided with two pushing units 5. The pushing unit 5 is provided with a rotational pushing element 11 in the form of a roller having the axis of rotation Y. The pushing roller 11 has a circumferential surface 11A in the form of a conical surface and is mounted on a shaft 12 which is swing-mounted on a lever 13, whereas the lever 13 is rotatably mounted on the axis Z (FIG. 1). On the same shaft 12, a second rotational pushing element 11 also in the form of a roller belonging to a second pushing unit 5 is mounted. The rollers 11 are situated at the right angle to the axis of the rod-shaped articles 4. A force is exerted on the lever 13 through the spring 16 which causes the pressure of the circumferential surfaces 11A of the rotational pushing elements 11 directly on the ends 4C of the rod-shaped article 4. The pushing units move substantially transversely to the axis of the flute 3 of the drum 2. As a result of the action of the apparatus 10 for shifting of the rod-shaped article 4, the rod-shaped article 4 is shifted in the flute 3.

FIGS. 2*a* and 2*b* show a plane A perpendicular to the axis X which in a particular case may be a symmetry plane of the drum 2, i.e. the symmetry plane for the front surfaces 14 and 15 of the drum 2. The plane A may overlap the plane of a not shown circular knife used to cut the article 4 into two parts, whereas the cutting of the article may take place further on the same drum conveyor 2 or on another mating drum. The shown example of the rod-shaped article 4 has its geometric centre at the point designated as B, and as can be seen in FIG. 2*a* it does not lie in the plane A. The distances of the ends 4C of the shown rod-shaped article 4 from the circumferential surfaces 11A of the pushing elements are described as the dimensions e1 and e2, whereas due to the asymmetrical position of the article 4 the dimension e1 is greater than e2. Also the distances d1 and d2 of the ends 4C of the rod-shaped article 4 from the drum's front surfaces 14 and 15 are shown, the surfaces 14 and 15 being situated symmetrically to the plane A and the dimension d2 being greater than d1.

During the rotation of the drum 2, the circumferential surfaces 11A successively come into contact with the ends 4C of successive rod-shaped articles 4. FIG. 2*a* shows a situation when the article 4 has been placed into the flute 3 of the drum 2 and has not yet been shifted enough for its centre B to be in the symmetry plane A of the drum 2. The circumferential surface 11A of the right pushing element 11 abuts against the end 4C of the rod-shaped article 4, but the process of shifting of the rod-shaped article 4 has not yet started. FIG. 2*b* shows a situation when the process of shifting of the rod-shaped article 4 in the flute 3 of the drum 2, in this case the process of centering of the rod-shaped article 4 relative to the plane A being the symmetry plane of the drum 2 has been completed. The position of the ends 4C of the rod-shaped article 4 has been defined by the circumferential surfaces 11A of both pushing elements 11. After the shift of the rod-shaped article 4, the ends 4C protrude beyond the front surfaces 14 and 15 of the drum 2 at the same distance d. The force exerted by the spring 16 is transferred by the rotational pushing elements 11 on the ends 4C of the article 4. The force of the spring 16 is selected in such a way that the ends 4C of the article 4 are not damaged. Each successive rod-shaped article 4 conveyed in the successive flute 3 is centered in a repeatable manner relative to the fixed plane A by means of the circumferential surfaces 11A of the pushing unit. The plane A does not have to be the symmetry plane of the drum 2, it may be independent of the drum structure. The apparatus 10 places the articles 4, 4' in a fixed position being symmetrical to the circumferential surfaces 11A independently of their actual length resulting from the length tolerance adopted during the production of the articles 4, 4'. The range of movements of the pushing units 5 which accomplish the centering function is selected so as to include the centering of the rod-shaped article 4 as well as of the individual rod-shaped article 4' for both maximum and minimum length of the rod-shaped article 4, 4', whereas the rod like articles 4, 4' always take a symmetrical position relative to the plane A.

It is possible to shift the rod-shaped articles 4, 4' in the flutes 3 by the circumferential surfaces 11A directly with the use of flexible rings 17, 18 (FIG. 2*c*) made for example of an elastic material. The rings 17, 18 rotate with the same rotational speed as the drum conveyor 2, whereas the distance between the rings is greater than the maximum length of the rod-shaped article 4, 4'. During the shifting of the rod-shaped article 4, 4' in the flute 3 takes place a momentary deformation of the edges of the rings 17, 18.

The apparatus for shifting of rod-shaped articles according to the invention may also be used for a group of several rod-shaped articles not wrapped with a common wrapping material (FIG. 3*a*), for example for a group 6 comprising a tobacco rod 6A, a filter rod 6B and a tobacco rod 6A, where from such group two cigarettes after prior wrapping of the filter rod 6B and the ends of the tobacco rods 6A with a paper wrapper will be manufactured. The apparatus shown may also be used for individual rod-shaped articles, for example filter rods 4' made of a single type of material (FIG. 6), whereas it may be a filter rod provided with a wrapping material or without a wrapping material, for example a non-wrapped acetate rod.

FIGS. 3*a* and 3*b* show the apparatus 20 for shifting of rod-shaped articles according to the invention in a second embodiment for a group 6 comprising three rod-shaped articles, namely two tobacco rods 6A and one filter rod 6B. The pushing elements 21 of each pushing unit 25 are provided with spherical surfaces 21A. FIG. 3*a* shows a situation when pushing of the articles 6A and 6B to abut against each other has started, while FIG. 3*b* shows a situation when pushing of the articles to abut against each other has finished, and the entire article group has been centered. During the rotation of the drum 2, the rod-shaped articles 4 come into contact with the circumferential surface 21 A belonging to the pushing unit 25 and, under the influence of the force transferred to the ends 4C the tobacco rods 6A are pushed to abut against the filter rod 6B and the group 6 is centered so that the geometric centre of the group is situated in the fixed plane A (FIG. 3*b*).

FIGS. 4*a* and 4*b* show the apparatus 30 for shifting of rod-shaped articles according to the invention in a fourth embodiment for a group 6 comprising three rod-shaped articles 6A, 6B and 6A, whereas the rollers 31 are inclined at the angle α to the axis of the rod-shaped articles, with conical circumferential surfaces 31A of the rotational pushing elements 31 belonging to the pushing units 35. Similar to the previous embodiments, FIG. 4*a* shows the moment of commencement of shifting of the articles 6A, 6B and 6A, whereas FIG. 4*b* shows the moment of finish of shifting of these articles. Similar to the previous embodiments, the pushing elements 31, symmetrically spaced relative to the plane A, push individual articles 6A, 6B and 6A to abut against each other and fix their position relative to the plane A. The pushing elements 31 may be cylindrical or conical.

FIG. 7 shows an apparatus 50 for shifting of rod-shaped articles according to the invention in a vertical operation system. The pushing unit 54 is slidably mounted essentially vertically by means of two elements 51 and 52, whereas a spring 53 for pushing of rotational pushing elements 11 to abut transversely against the axis of rotation X of the drum 2 was used. The pushing unit may be any of the units presented above.

The invention claimed is:

1. Method for shifting of rod-shaped articles wherein:

at least one rod-shaped article (4, 4'), or a rod-shaped article group comprising rod-shaped articles (6), is conveyed in a flute (3) situated on the circumference of a drum conveyor (2), wherein the length of the at least one rod-shaped article (4, 4'), or the total lengths of the rod-shaped articles comprising the rod-shaped article group (6), in each flute (3) may vary, whereas a pushing unit (5, 25, 35) forcing the movement of the at least one rod-shaped article is shifted in a direction being substantially transverse to an axis of the flute (3) of the drum conveyor (2), whereas the pushing unit (5, 25, 35) has surfaces (11 A, 21 A, 31 A) situated angularly to the axis of the flute (3) the drum conveyor (2), characterised in that the at least one rod-shaped article (4, 4'), or the rod-shaped article group (6), is axially shifted in the flute (3) by means of the surfaces (11 A, 21 A, 31 A) of the pushing unit (5, 25, 35).

2. Method as in claim 1 characterised in that the at least one rod-shaped article (4, 4'), or the rod-shaped article group (6), is axially shifted in the flute (3) directly with the use of flexible rings (17, 18) by means of the surfaces (11 A, 21 A, 31 A) of the pushing unit (5, 25, 35).

3. Method as in claim 1 characterised in that at least two pushing units (5, 25, 35) mounted on both sides of the flute (3) of the drum conveyor (2) are shifted in a direction being substantially transverse to the axis of the at least one rod-shaped article (4, 4'), or the rod-shaped article group (6), whereas by means of the surfaces (11 A, 21 A, 31 A) of the pushing unit (5, 25, 35) situated on both sides of the flute (3) of the drum conveyor the force exerted by the pushing unit (5, 25, 35) is directed on the rod-shaped articles (4, 4') so that the centers of the at least one rod-shaped article (4, 4'), or rod-shaped article group (6), in the flutes (3) of the drum conveyor (2) are positioned substantially in a common plane.

4. Apparatus (10, 20, 30) for shifting of the at least one rod-shaped article (4, 4') of different length, or rod-shaped article group (6) of different total length, on a drum conveyor (3), comprising a pushing unit (5, 25, 35) mounted angularly to the axis of rotation of the drum conveyor (2) forcing a movement of the at least one rod-shaped article (4, 4'), whereas the pushing unit (5, 25, 35) comprises rotational pushing elements (11 , 21 , 31) for shifting of the at least one rod-shaped article (4, 4'), characterised in that the pushing unit (5, 25, 35) is movably mounted in a direction being substantially transverse to the axis of the flute (3) of the drum conveyor (2) adapted to shift axially the at least one rod-shaped article (4, 4'), or the rod-shaped article group (6), inside the flute (3) of the drum conveyor (2) by pressure of surfaces (11 A, 21 A, 31 A) of the pushing unit (5, 25, 35) on the ends of the at least one rod-shaped article (4, 4').

5. Apparatus as in claim 4 characterised in that the pushing unit (5, 25, 35) is movably mounted in a direction being substantially transverse to the axis of the flute (3) of the drum conveyor (2) so as to shift the at least one rod-shaped article (4, 4'), or the rod-shaped article group (6), inside the flute (3) of the drum conveyor (2) by the pressure of the surfaces (11 A, 21 A, 31 A) of the pushing unit (5, 25, 35) directly on the ends of the at least one rod-shaped article (4, 4').

6. Apparatus as in claim 4 characterised by comprising at least two pushing units (5, 25, 35) mounted angularly to the axis of the flute (3), on both sides of the flute (3) of the drum conveyor (2), whereas the pushing units (5, 25, 35) are movably mounted in a direction being substantially transverse to the axis of the flute (3) of the drum conveyor (2) so as to shift the at least one rod-shaped article (4, 4'), or the rod-shaped article group (6), inside the flute (3) of the drum conveyor (2) so that the centers of the at least one rod-shaped article (4, 4'), or the rod-shaped article group (6), in the flute (3) of the drum conveyor (2) position themselves substantially in a common plane.

7. Apparatus as in claim 4 characterised in that the contact of the rotational pushing elements (11, 21, 31) of the pushing unit (5, 25, 35) with the at least one rod-shaped article (4, 4'), or the rod- shaped article group (6), is effected by means of a spring (16, 53).

8. Apparatus as in claim 4 characterised in that the rotational pushing elements (11, 21, 31) have circumferential surfaces (11 A, 21A, 31A) selected from the group: a conical, spherical, cylindrical, paraboloidal surface.

* * * * *